US010392174B2

(12) United States Patent
Troxell

(10) Patent No.: US 10,392,174 B2
(45) Date of Patent: Aug. 27, 2019

(54) BEVERAGE CONTAINER WITH INTERNALLY RETAINED DISPENSER BOTTLES

(71) Applicant: Justin Shane Troxell, Port St. Lucie, FL (US)

(72) Inventor: Justin Shane Troxell, Port St. Lucie, FL (US)

( * ) Notice: Subject to any disclaimer, the term of this patent is extended or adjusted under 35 U.S.C. 154(b) by 0 days.

(21) Appl. No.: 15/859,715

(22) Filed: Jan. 1, 2018

(65) Prior Publication Data

US 2018/0155106 A1 Jun. 7, 2018

Related U.S. Application Data

(63) Continuation-in-part of application No. 14/702,368, filed on May 1, 2015, now Pat. No. 9,856,076.

(60) Provisional application No. 61/986,916, filed on May 1, 2014.

(51) Int. Cl.

| | |
|---|---|
| ***B65D 77/00*** | (2006.01) |
| ***B65D 77/06*** | (2006.01) |
| ***B65D 5/70*** | (2006.01) |
| ***B65D 85/72*** | (2006.01) |
| ***B65D 33/01*** | (2006.01) |
| ***B65D 77/24*** | (2006.01) |
| ***B65D 25/56*** | (2006.01) |
| ***B65D 77/04*** | (2006.01) |

(52) U.S. Cl.

CPC ..... *B65D 77/067* (2013.01); *B65D 5/705* (2013.01); *B65D 25/56* (2013.01); *B65D 33/01* (2013.01); *B65D 77/0426* (2013.01); *B65D 77/068* (2013.01); *B65D 77/24* (2013.01); *B65D 77/245* (2013.01); *B65D 85/72* (2013.01)

(58) Field of Classification Search

CPC ..... B65D 77/067; B65D 5/705; B65D 25/56; B65D 33/01; B65D 77/24; B65D 85/72; B65D 77/0426; B65D 77/068; B65D 77/245; B65D 5/70; B65D 5/708; B65D 77/00

USPC ..... 206/223, 217, 576, 577; 221/96, 92; 220/495.01, 495.05

See application file for complete search history.

(56) References Cited

U.S. PATENT DOCUMENTS 3,331,533 A * 7/1967 Krugger ..... A47F 1/085 221/310
3,349,960 A * 10/1967 Ketler ..... B67D 3/0009 221/63
3,453,033 A * 7/1969 Goss ..... B67D 3/00 220/495.05
RE38,377 E * 1/2004 Geshay ..... B65D 5/4608 221/96

(Continued)

*Primary Examiner* — Rafael A Ortiz

(74) *Attorney, Agent, or Firm* — Ellenoff Grossman & Schole LLP; James M. Smedley, Esq

(57) ABSTRACT

The present invention generally relates to liquid, beverage, and/or dietary supplement dispensers. Specifically, embodiments of the present invention are configured to provide a liquid or beverage dispenser that allows for convenient shipping and storage of a liquid, beverage, dietary supplement, dietary supplement mixture or beverage mixture while also providing for safe storage and shipping of one or more dispenser bottles, serving vessels, or similar liquid holding vessels to be used in conjunction with the liquid, beverage, or dietary supplement contained in the dispenser.

17 Claims, 5 Drawing Sheets

(56) References Cited

U.S. PATENT DOCUMENTS

| | | | | |
|---|---|---|---|---|
| 6,951,294 | B1 * | 10/2005 | Laberinto | G01F 11/24 222/142 |
| 2005/0077321 | A1 * | 4/2005 | Liston | B65D 47/2025 222/185.1 |
| 2010/0018988 | A1 * | 1/2010 | Reineccius | A47F 1/085 221/96 |
| 2013/0220849 | A1 * | 8/2013 | McCarthy | B65D 77/062 206/223 |

* cited by examiner

BEVERAGE CONTAINER WITH INTERNALLY RETAINED DISPENSER BOTTLES

CROSS-REFERENCE TO RELATED APPLICATIONS

This application is a continuation of U.S. patent application Ser. No. 14/702,368, filed on May 1, 2015, which claims the benefit of U.S. Provisional Patent Application No. 61/986,916, filed on May 1, 2014, all of which are hereby incorporated by reference in their entirety.

FIELD OF THE INVENTION

The present invention generally relates to liquid, beverage, and/or dietary supplement dispensers. Specifically, embodiments of the present invention are configured to provide a liquid or beverage dispenser that allows for convenient shipping and storage of a liquid, beverage, dietary supplement, dietary supplement mixture or beverage mixture while also providing for safe storage and shipping of one or more dispenser bottles, serving vessels, or similar liquid holding vessels to be used in conjunction with the liquid, beverage, or dietary supplement contained in the dispenser.

BACKGROUND OF THE INVENTION

Liquid dietary supplements and energy shots are often sold in single serve containers. Therefore, in order to reduce the cost per serving, manufacturing costs, or environmental impact and/or to increase product utility or manufacturing and packaging efficiencies, it can be advantageous to sell such dietary supplements and energy drinks in bulk packaging that contains any suitable number of individual servings. For example, a dietary supplement or energy drink could be sold in a multi-serving or bulk container, such as a liquid bladder, from which a number of individual servings could be served. However, bulk packaging presents a significant problem for measuring and dispensing a proper serving or dosage size. In particular, the use of liquid bulk packaging, wherein multiple servings are held in a bladder, can make it difficult to dispense a proper serving size in that the liquid bulk packaging medium is not suitable to merchandise or market because of the concern that overconsumption may result. Additionally, while it may be an option to include a refillable bottle or other metered vessel outside of the bulk package, efficiently packaging the refillable bottle or other metered vessel outside of the bulk packaging presents problems for the shipping and marketing the product. For example, the refillable bottle or other metered vessel can inflict damage on or be damaged by the bulk packaging holding the liquid, beverage, or dietary supplement. Likewise, having a refillable bottle or other metered vessel on the outside of the bulk packaging creates problems with marketing and merchandising the product, because with the refillable bottle or other metered vessels packaged on the outside of the bulk packaging, the product takes up extra shelf space and cannot be arranged efficiently. Finally, by packaging the refillable bottle or other metered vessel outside of the bulk packaging container, those items can often be separated from the main packaging by ordinary movements that occur at retail, as well as by theft.

Therefore, there is a need in the art for a bulk liquid or beverage container with internally retained refillable bottles or other metered vessels that can be used to ensure proper serving sizes of the liquid or beverage that is contained within the bulk packaging container. These and other features and advantages of the present invention will be explained and will become obvious to one skilled in the art through the summary of the invention that follows.

SUMMARY OF THE INVENTION

Accordingly, it is an object of the present invention to provide a bag-in-box container for the bulk packaging of liquids, including but not limited to, beverages, dietary supplements, and energy drinks, that further includes one or more refillable vessels that are packaged within the container and used to serve the liquid in a preferred or recommended serving size. In particular, such packaging may be useful for the bulk packaging of energy shots or liquid dietary supplements where it is more cost effective to package product in bulk, but also advantageous to have a refillable liquid serving vessel, which may or may not be metered, that guides a user into consuming the appropriate serving size or dose.

According to an embodiment of the present invention, an apparatus for a liquid storage and dispensing container with internally retained serving vessels, the apparatus comprising: a bladder with an integrated dispensing means that is fluidly connected to the interior of the bladder, one or more serving vessels, and a container comprising one or more walls that surround a hollow cavity formed inside of the container and one or more perforated sections formed in at least one of the walls, wherein the hollow cavity is configured to receive the bladder and the serving vessels, wherein at least one of the perforated sections is at least partially detachable from the wall in which the perforated section is formed so as to provide a detachable perforated section that serves as an access point into the hollow cavity for retrieving and removing the dispensing means or the serving vessels from within the hollow cavity.

According to an embodiment of the present invention, the serving vessels are retained in a void that is formed between the bladder and one or more of the walls.

According to an embodiment of the present invention, the bladder presses the serving vessels against one of the walls to secure the serving vessels within the hollow cavity.

According to an embodiment of the present invention, the container further comprises one or more vessel compartments that are formed inside of the hollow cavity and configured to receive and secure the serving vessels within the hollow cavity According to an embodiment of the present invention, each of the vessel compartments are accessed via a compartment access point that is provided by one or more of the perforated sections.

According to an embodiment of the present invention, at least one side of at least one of the perforated sections is permanently attached to the wall such that the perforated section is movable between an open position and a closed position over the access point.

According to an embodiment of the present invention, at least one of the serving vessels further comprises a volume measurement meter aligned along a vertical axis of the serving vessel.

According to an embodiment of the present invention, the dispensing means comprises a tap head, a valve, and a tap operation means.

According to an embodiment of the present invention, the dispensing means further comprises a box engagement means.

According to an embodiment of the present invention, an apparatus for a liquid storage and dispensing container with internally retained serving vessels, the apparatus comprising: a bladder with an integrated dispensing means that is fluidly connected to the interior of the bladder, one or more serving vessels, and a container comprising a bottom wall having a front edge that is opposite a rear edge and two oppositely located side edges, a front wall connected to and extending vertically from the front edge of the bottom wall, a rear wall connected to and extending from the rear edge of the bottom wall, a side wall connected to and extending vertically from each of the side edges of the bottom wall such that a front edge of the side wall is connected to the front wall and a rear edge of the side wall is connected to the rear wall, a top wall having side edges that connect to the front, rear, and side walls, and one or more perforated sections formed in at least one of the walls of the container, wherein the walls collectively define a hollow cavity that is formed inside of the container and configured to receive the bladder and the serving vessels such that the serving vessels are retained in a void that is formed between the bladder and one or more of the walls, wherein at least one of the perforated sections is at least partially detachable from the wall in which the perforated section is formed so as to provide a detachable perforated section that serves as an access point into the hollow cavity for retrieving and removing the dispensing means or the serving vessels from within the hollow cavity.

According to an embodiment of the present invention, the serving vessels are held in place within the void such that the bladder presses the serving vessels against at least one of the walls.

According to an embodiment of the present invention, an apparatus for a liquid storage and dispensing container with internally retained serving vessels, the apparatus comprising: a bladder with an integrated dispensing means that is fluidly connected to the interior of the bladder, one or more serving vessels, and a container comprising a bottom wall having a front edge that is opposite a rear edge and two oppositely located side edges, a front wall connected to and extending vertically from the front edge of the bottom wall, a rear wall connected to and extending from the rear edge of the bottom wall, a side wall connected to and extending vertically from each of the side edges of the bottom wall such that a front edge of the side wall is connected to the front wall and a rear edge of the side wall is connected to the rear wall, a top wall having side edges that connect to the front, rear, and side walls, and one or more perforated sections formed in at least one of the walls of the container, wherein the walls collectively define a hollow cavity that is formed inside of the container and configured to receive the bladder and the serving vessels, wherein at least one of the perforated sections is at least partially detachable from the wall in which the perforated section is formed so as to provide a detachable perforated section that serves as an access point into the hollow cavity for retrieving and removing the dispensing means or the serving vessels from within the hollow cavity.

According to an embodiment of the present invention, the apparatus further comprises at least a first detachable perforated section that provides a first access point for removing and retrieving the dispensing means from within the hollow cavity and second detachable perforated section that provides a second access point for removing and retrieving at least one of the serving vessels from within the hollow cavity.

According to an embodiment of the present invention, the container further comprises one or more vessel compartments that are formed inside of the hollow cavity and defined by one or more compartment walls that abut the walls of the container, each of which are configured to receive and secure at least one of the serving vessels within the hollow cavity.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

BRIEF DESCRIPTION OF THE DRAWINGS

For the purposes of illustration, there are forms shown in the drawings that are presently preferred, it being understood, however, that the invention is not limited to the precise arrangements and instrumentalities shown.

DETAILED SPECIFICATION

Figure 1:
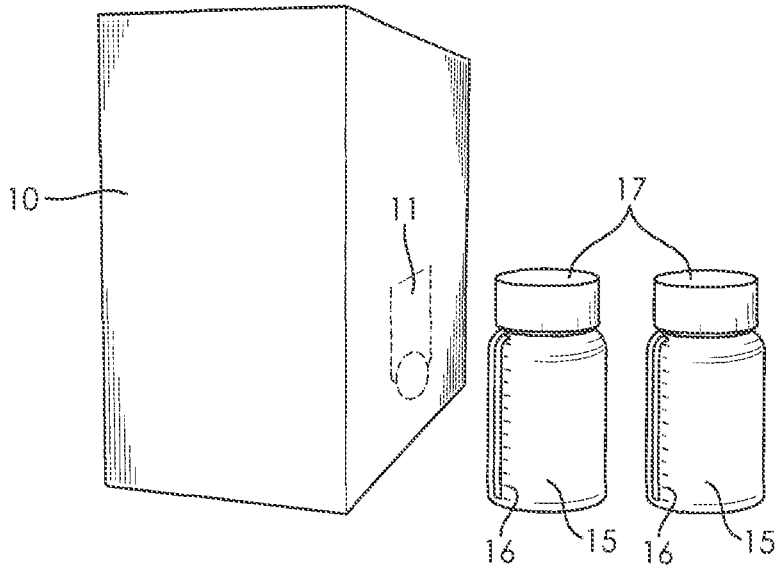
FIG. 1 illustrates an exemplary embodiment of a beverage dispenser and metered bottle(s) in accordance with an embodiment of the present invention.

The present invention generally relates to liquid, beverage, and/or dietary supplement dispensers. Specifically, embodiments of the present invention are configured to provide a liquid or beverage dispenser that allows for convenient shipping and storage of a liquid, beverage, dietary supplement, dietary supplement mixture or beverage mixture while also providing for safe storage and shipping of one or more dispenser bottles, serving vessels, or similar liquid holding vessels to be used in conjunction with the liquid, beverage, or dietary supplement contained in the dispenser.

For reference, as used herein and throughout this disclosure, the term beverage and dietary supplements may be used interchangeably and would be understood by one of ordinary skill in the art as referring to a consumable liquid, powder, gel or other food stuff, including dietary supplements and various forms thereof. The term beverage may refer to any form of liquid, powder, gel or other food stuff suitable for storage in the bladder, including, but not limited to, energy drinks, energy shots, pre-workout formulations, concentrated solutions for immediate or future consumption, concentrated solutions for immediate or future dilution, wine, tea, protein drinks, sports drinks, soda, and alcohol. One of ordinary skill in the art would appreciate that there are numerous types of beverages and concentrates that could be stored in the bladder and embodiments of the present invention are contemplated for use with any type of beverage. The term beverage mixture may refer to any form of mix or other ingredient used to make a beverage, including, but not limited to, protein powders, vitamin powders, syrups, beverage flavorings (e.g., powdered, liquid), or any combination thereof. One of ordinary skill in the art would appreciate that there are numerous types of beverage mixtures that could be utilized with embodiments of the present invention, and embodiments of the present invention are contemplated for use with any type of beverage mixture.

According to an embodiment of the present invention, a beverage dispenser of the present invention comprises a box or other container with a rigid or semi-rigid exterior suitable for sustaining the rigors of shipping and handling between a first point (e.g., manufacturer, distributor, warehouse) and a second point (e.g., retailer, distributor, consumer). Materials for the rigid or semi-rigid exterior could include, but are not limited to, corrugated cardboard, cardboard, rigid or semi-rigid plastics, or any combination thereof. One of ordinary skill in the art would appreciate that there are numerous box materials that could be utilized with embodiments of the present invention, and embodiments of the present invention are contemplated for use with any appropriate box material.

According to an embodiment of the present invention, the inside of the box is a hollow cavity. This hollow cavity is configured to receive a bladder suitable to retain an amount of beverage or beverage mixture. In a preferred embodiment, the bladder, when filled with beverage or beverage mixture, is configured to consume a substantial portion of the hollow cavity of the box. Materials suitable for use as a bladder include, but are not limited to, food grade plastics, other plastics, metalized films, polymer films, vinyl or other pliable or deformable materials that could be retained inside the hollow cavity. In a preferred embodiment of the present invention, the bladder would be constructed from a material that allows for usage as a bladder for containing beverages or other beverage mixtures. One of ordinary skill in the art would appreciate that there are numerous bladder materials that could be utilized with embodiments of the present invention, and embodiments of the present invention are contemplated for use with any appropriate bladder material.

According to an embodiment of the present invention, the box may be comprised of one or more perforated sections to allow for a portion of the box to be opened or removed without significantly altering the structural integrity of the box. Ideally, the perforated sections allow for the opening or removal of a portion of an exterior wall of the box in order to allow for components situated behind the perforation to be retrieved. For instance, in a preferred embodiment of the present invention, three sides of a perforated section may be separated from the box, leaving a fourth side remaining attached and allowing for moving between a closed and an open state created by the separation of the three sides of the perforated section. Further embodiments allow for one or more of the components to be retrieved from behind the perforation in conjunction with the perforated section of the box. Finally, in some embodiments, the perforated sections may be formed so as to provide a handle or handhold for carrying the box. For example, a perforated section could be substantially separated and lifted away from the box in order to provide a carrying handle that remains at least partially connected to the box. Likewise, a perforated section could be substantially separated and pushed into the box in order to provide a handhold. One of ordinary skill in the art would appreciate that the perforated sections could be adapted for a variety of functions, and embodiments of the present invention are contemplated for use with any such function.

According to an embodiment of the present invention, the box may be of any shape and size, not limited to more commonly used shapes, such as rectangles and squares. In fact, embodiments of the present invention may utilize a box shaped in any number of geometric shapes or combinations thereof, such as cylinders, spheres, rhomboids, cubes, or any combination thereof. One of ordinary skill in the art would appreciate that a box could be made of any shape, and embodiments of the present invention are contemplated for use with any appropriate shape.

According to an embodiment of the present invention, components that may be retrieved from the box include, standard bottles, metered bottles and a spout, tap or other dispensing means (collectively referred to throughout as "tap" or "taps"). In a preferred embodiment of the present invention, the components include at least one tap that is integrated onto the bladder contained in the box and allows for dispensing of the beverage or beverage mixture through the tap. When not in operation, the tap seals and prevents beverage or beverage mixture to seep or flow through the tap. A preferred embodiment of a tap may include a faucet head and open/close valve operated by a tap operation means, such as a knob, level, switch, butterfly piston valve, push tap, toggle valve, or other operable means for moving the valve between an open and closed setting. A rear portion of the tap may be connected to or extend into the bladder where the beverage or beverage mixture is stored. One of ordinary skill in the art would appreciate that there are numerous types of taps that could be utilized with embodiments of the present invention, and embodiments of the present invention are contemplated for use with any type of tap.

According to an embodiment of the present invention, the tap may comprise a box engagement means that is configured to allow the tap to be retained upon an opening left in the box created upon the opening or removal of a perforated section. The engagement means may be, for instance, a rigid rear wall and a pliable front element, such as an O-ring, wherein the pliable front element allows for the tap to be pulled through and firmly engaged on the portion of the box left open via a perforated section by way of a friction/interference fit. A preferred embodiment of the engagement means may be a gland, or a flange as commonly used in bag-in-a-box packaging. One of ordinary skill in the art would appreciate that there are numerous types of engagement means that could be utilized with embodiments of the present invention, and embodiments of the present invention are contemplated for use with any appropriate engagement means. Further, it should be noted that the tap could be located anywhere on the box, and no specific alignment of the tap is required.

According to an embodiment of the present invention, the retrievable components include one or more metered dispenser bottles, serving vessels, or similar dispensing vessels. The metered dispenser bottles or serving vessels are generally sized for individual use (e.g., retaining 1-2 servings of a beverage), although other embodiments may provide for multi-serving or multi-person use (e.g., dispensing enough servings for a table at a restaurant) or the serving vessels may be used to measure out liquids that can be used to dilute concentrated formulations that are dispensed from the bulk packaging. In a preferred embodiment, the metered dispenser bottles or serving vessels include a visible meter along a vertical axis of an exterior wall of the metered dispenser bottle. The visible meter allows for the amount of beverage dispensed from a tap to be accurately measured. In cases where a beverage mixture is utilized, the metered bottles could provide a first meter indicator for the beverage mixture and a second meter indicator for a second beverage additive (e.g., water). As an illustrative example, in cases where a heavily concentrated solution is dispensed from the bulk packaging, the metered bottles or vessels could provide a basis for diluting the concentrate into a larger volume of liquid such as water. In some embodiments, shot glasses, measuring glasses, measuring cups, tumblers, or other metered liquid holding vessels may be substituted for a metered dispenser bottle. One of ordinary skill in the art would appreciate that there are many types of bottle, cups, a glasses, and tumblers that would be suitable for use as a dispensing vessel, and embodiments of the present invention are contemplated for use with any such dispensing vessel.

According to an embodiment of the present invention, the beverage container is configured to receive one or more bottles (preferably metered bottles) or similar serving vessels inside the box portion of the apparatus such that the bottles or serving vessels are retained upon a wall of the box through fluidic or other pressure created by the bladder containing the beverage or beverage mixture or though general placement in a void between the bladder and the walls of the box. In a preferred embodiment, the bottles will be retained near one of the perforated sections such that the bottles can be retrieved when the perforated section is removed. In this preferred embodiment, both the bottles and tap will be retained near a single perforated section. In other embodiments, one or more bottles and the tap can be located and retained at or near two or more perforated sections.

Exemplary Embodiments

Turning now to FIG. 1, an exemplary embodiment of the present invention is shown. In FIG. 1, a box 10 is shown alongside two metered bottles 15. A perforated section 11 of the box 10 is shown, such perforated section being capable of retrieving the metered bottles through when perforated (the bottles being inserted during formation of the box). The metered bottles having vertically aligned visible meter 16 and a cap 17. In a preferred embodiment, the vertically aligned visible meter may be incremented in any denomination, such as 0.5 ml, 1 ml, 0.5 oz., 1 oz., or any other denomination or combination of denominations.

Figure 2:
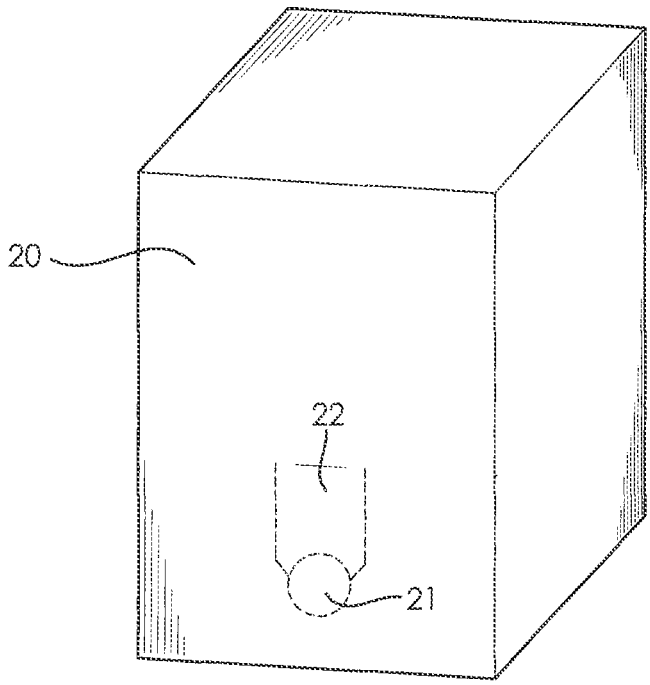
FIG. 2 illustrates an exemplary embodiment of a beverage dispenser in accordance with an embodiment of the present invention.

Turning now to FIG. 2, an exemplary embodiment of the present invention is shown. In FIG. 2, a box 20 is shown. The box 20 is comprised of two separate perforated sections. A first perforated section 21 configured to be fully removable and to be of a size and shape appropriate to allow a tap to be secured through and a second perforated section 22, being perforated only such that the second perforated section can be partially detached from the box 20, while allowing for the second perforated section 22 to be used as a flap to further secure a tap in place once pulled through the opening formed from the removal of the first perforated section 21.

Figure 3:
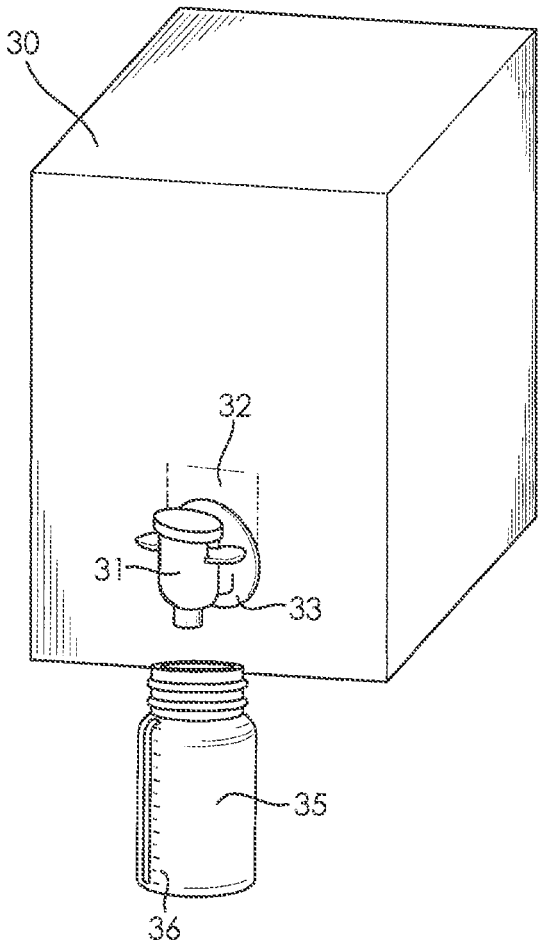
FIG. 3 illustrates an exemplary embodiment of a beverage dispenser and metered bottle(s) in accordance with an embodiment of the present invention.

Turning now to FIG. 3, an exemplary embodiment of the present invention is shown. In FIG. 3, a box 30 is shown with a tap 31 extending through a perforated section 32 and retained on the walls of the box by an engagement means 33. A metered bottle 35 is also shown with vertically aligned visible meter 36.

Figure 4:
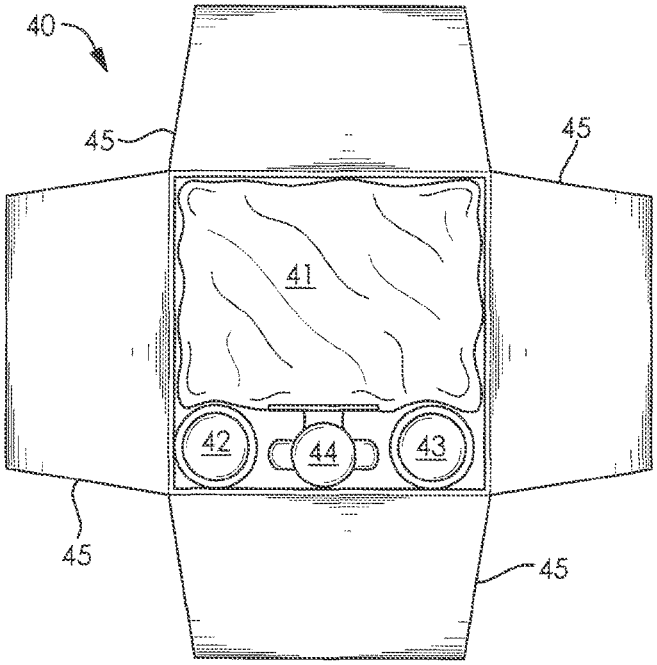
FIG. 4 illustrates an exemplary embodiment of a beverage dispenser and metered bottle(s) in accordance with an embodiment of the present invention.

Turning now to FIG. 4, an exemplary embodiment of the present invention is shown. In FIG. 4, a box 40 is shown in a state of preparation prior to shipping. The box has not been sealed, but the bladder 41 has been inserted and filled, putting outward pressure on metered bottles 42 and 43 as well as on tap 44 in order to retain these elements in place during shipping and handling. When fully prepared, the folding elements 45 of the box may be folded inward and sealed (e.g., via a sealing component, such as glue, adhesives, epoxies, tape, tuck fit, or other element suitable for sealing the folding elements 45 in a closed position.

Figure 5:
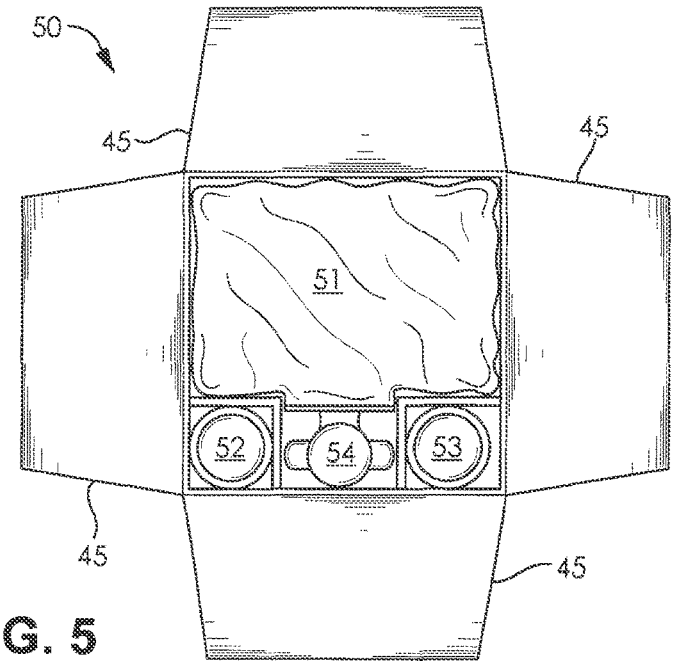
FIG. 5 illustrates an exemplary embodiment of a beverage dispenser and metered bottle(s) in accordance with an embodiment of the present invention.

Turning now to FIG. 5, an exemplary embodiment of the present invention is shown. In FIG. 5, a box 50 is shown in a state of preparation prior to shipping. The box has not been sealed, but the bladder 51 has been inserted and filled. Metered bottles 52 and 53 are retained in separate compartments and are retrievable through perforated sections (not shown) on the exterior portion of the box 50. The tap 54 is attached to bladder 51 and will be retrievable through a separate perforated section (not shown) on the exterior portion of the box 40. When fully prepared, the folding elements 45 of the box may be folded inward and sealed (e.g., via a sealing component, such as glue, adhesives, epoxies, tape, tuck fit, or other element suitable for sealing the folding elements 45 in a closed position.

Figure 6:
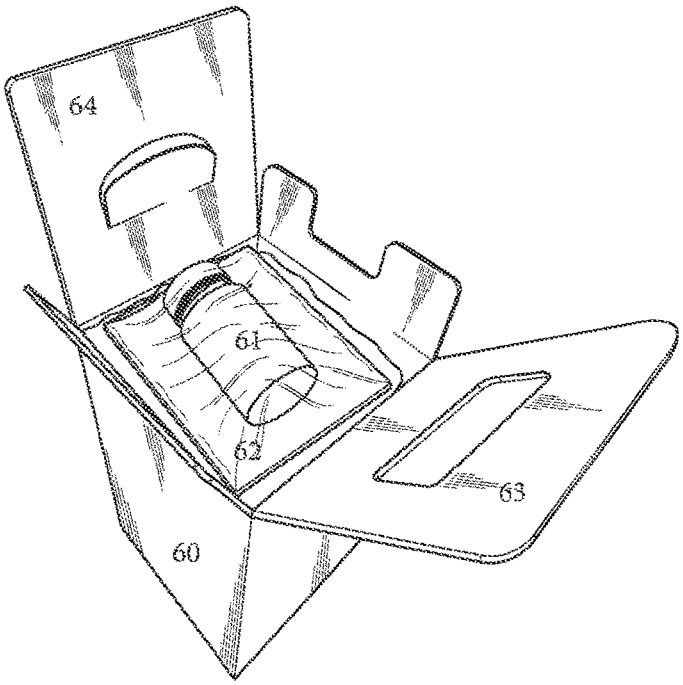
FIG. 6 illustrates an exemplary embodiment of a beverage dispenser and metered bottle(s) in accordance with an embodiment of the present invention.

Turning now to FIG. 6, an exemplary embodiment of the present invention is shown. In FIG. 6, a box 60 is shown, with a bottle, 61 attached to a card 62. In this embodiment, a card, such as a rectangular piece of cardboard is situated between the bladder and the bottle 61. In some embodiments, the card may be made of rigid or semi-rigid materials, such as plastic, cardboard, or other similar material. One of ordinary skill in the art would appreciate that there are numerous types of materials that could be utilized with embodiments of the present invention, and embodiments of the present invention are contemplated for use with cards of any appropriate materials.

The bottle 61 may be secured to the card 62 by one or more means, such as being shrink wrapped together, glued together, or otherwise secured to one another. One of ordinary skill in the art would appreciate that there are numerous means for securing the bottle 61 to the card 62. Advantageously, when the bottle 61 is secured to the card 62, wherein the card is placed against the bladder, pressure between the card and the bladder is created (which is increased as the bottle presses against a top edge of the box 60) such that the bladder further retains and secures other components within the box (such as the integrated dispenser component). By creating pressure against the bladder, less movement occurs inside the box 60, and therefore protects the entire apparatus. The movement of the components is further reduced when the top edges of the box, such as the folding top elements 63, 64 are sealed on top of the bottle 61. The reduction in movement also reduces friction caused between elements of the box (or any other element, like a card or bottle) and the bladder, thereby reducing damage caused by such movement.

In FIG. 6, the bottle is shown attached to the card, and while it may, at first glance, appear that the bottle is too large to fit through an opening on a top side of the box 60, preferred embodiments of the present invention are contemplated for use with bottles that are the appropriate size to be removed from this opening. Larger or smaller bottles may be used as well. In some embodiments, when larger bottles are used, the top (or other side) may be opened before removal of the bottle. In other embodiments, larger perforated sections may be used when larger bottles are used. One of ordinary skill in the art would appreciate that there are numerous configurations of bottles and perforated sections that could be used with embodiments of the present invention, and embodiments of the present invention are contemplated for use with any size/configuration of bottles and perforated sections.

Further, preferred embodiments of the present invention may include perforations on the shrink wrap attaching the bottle 61 to the card 62, allowing for the bottle 61 to be easily detached from the card 62 when ready. One of ordinary skill in the art would also appreciate other securing means could comprise other easy to detach means in order to allow secured bottles to be easily released. For instance, the bottles could be secured to the card via a twist lock means, and by twisting the bottle in a direction (e.g., clockwise, counterclockwise) they could be released from the card and then removed from a perforated section or opening on the box.

In still further embodiments, the card and/or box could comprise bottle shaped indents, in lieu of or in conjunction with securing means, in order to retain the bottles in place. In this manner, the bottles are retained in place by a combination of pressure, and natural tendency to remain in the formed indent. One of ordinary skill in the art would appreciate that there are numerous types of indents that could be used, and embodiments of the present invention are contemplated for use with cards or boxes with any type of indents.

Finally, in certain embodiments, one or more bottles may merely rest upon card in an unsecured manner, allowing for the natural pressure between the box, bladder and card, to hold the entire combination in place.

Figure 7:
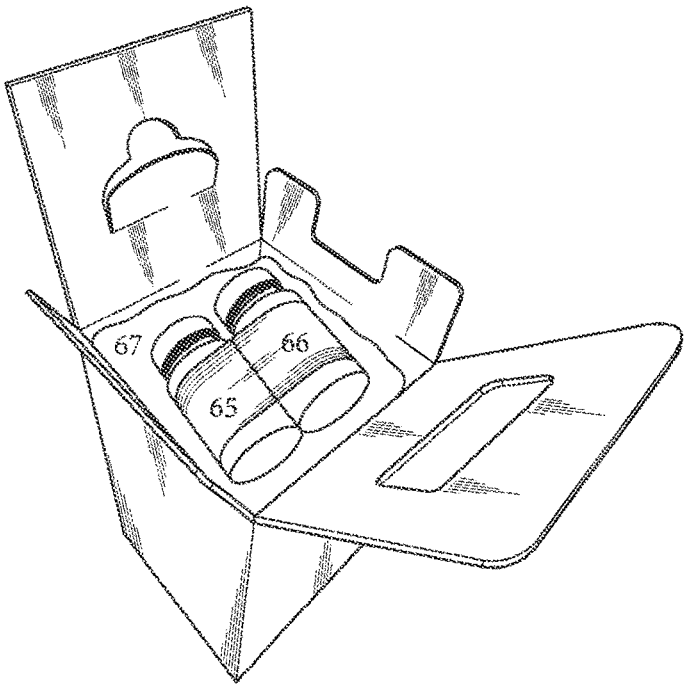
FIG. 7 illustrates an exemplary embodiment of a beverage dispenser and metered bottle(s) in accordance with an embodiment of the present invention.

Turning now to FIG. 7, a similar embodiment to the embodiment in FIG. 6 is shown. However, in this embodiment, multiple bottles 65, 66 are attached to the card 67. Similar results are achieved in a multi-bottle embodiment as those in the single bottle embodiments of FIG. 6. However, further, in certain embodiments, particularly those with multiple bottles, the card 67 may be removed and the multiple bottles 65, 66 could be secured together (e.g., via shrink wrap or other securing means) and provide similar pressure against the bladder by way of a side of the box pressing against the secured bottles.

Figure 8:
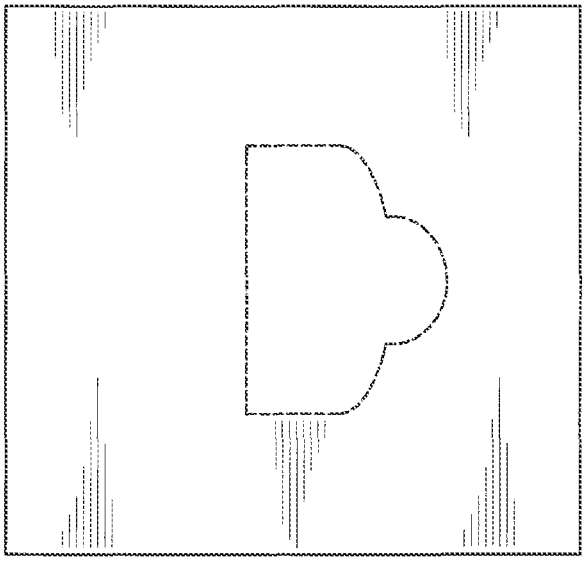
FIG. 8 illustrates an exemplary embodiment of a beverage dispenser and metered bottle(s) in accordance with an embodiment of the present invention.
Figure 9:
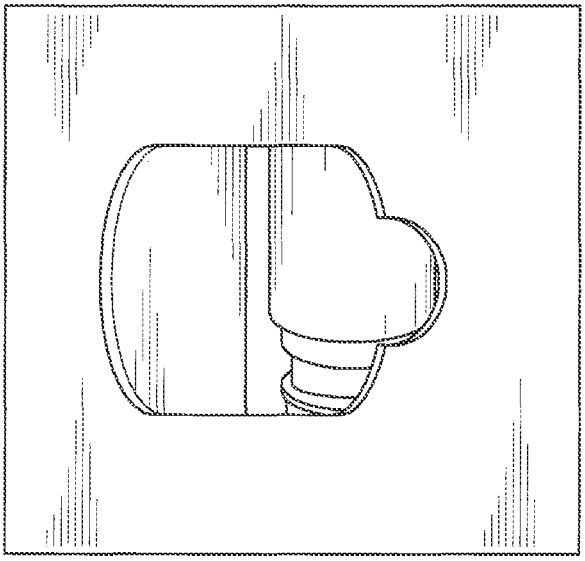
FIG. 9 illustrates an exemplary embodiment of a beverage dispenser and metered bottle(s) in accordance with an embodiment of the present invention.

Turning to FIGS. 8-9, an embodiment is shown where a box 80 includes a perforated section 81 on a top portion of the box 80. In these embodiments, one or more bottles 82 may be removed from an interior cavity of the box 80 through the perforated top section 81 when the perforated section 81 is opened. Similar to details in FIG. 6, the size, shape and form of the bottles may vary from those shown in the figures. Bottles of any size may be used, and preferred embodiments may utilize bottles that are removable from a opening in a side of the box (e.g., top). While the top may be shown as a place for the bottles to be removed in many of the figures, one of ordinary skill in the art would appreciate that the opening or holes for removing the bottles could be on any side or wall of the box. Further, for clarity, throughout this disclosure, the term side includes curved walls or other non-linear walls of the box, such as those found on a cylindrical box.

According to an embodiment of the present invention, one or more of the perforated sections may further comprise a second perforation formed in the first perforated section. The second perforated section allows for a small portion to act as a flap and allow for pulling back or otherwise adjusting the first perforated section, or, in other cases, removing the first perforated section. One of ordinary skill in the art would appreciate the usefulness and purpose of this second perforated section, and second perforated sections of any shape, form or size may be utilized with embodiments of the present invention.

According to an embodiment of the present invention, the box may further comprise one or more handles attached to or formed upon the box. For instance, in certain embodiments, handles may be attached to one or more sides of the box and may be extended or retracted into a portion of the box. In other embodiments, handles may be formed into the box, such as flaps on a corrugated cardboard box. One of ordinary skill in the art would appreciate that there are numerous means and methods for forming or attaching handles to the box, and embodiments of the present invention are contemplated for use with any type of handles.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. An apparatus for liquid storage and dispensing, said apparatus comprising:

a bladder with an integrated dispenser in fluid communication with the interior of said bladder;

one or more serving vessels; and a container including one or more walls, a floor, and one or more flaps for sealing the container, wherein said floor and one or more walls define a hollow cavity formed inside of said container, wherein the container includes a perforated section formed in at least one of said walls of said container, wherein the perforated section includes a perforated middle section and a perforated upper section, wherein said hollow cavity is configured to receive said bladder such that when said bladder is installed in said container the walls of said bladder directly abut the walls of said container, when said bladder is filled with fluid, wherein the one or more serving vessels is disposed in a corner of said container and abuts one side of said fluid-filled bladder, wherein the perforated middle section is fully detachable from said wall in which said perforated middle section is formed so as to provide an opening for said dispenser to be pulled through said wall when a user is ready to use the dispenser for dispensing fluid from inside said bladder, wherein the fully detachable perforated middle section shares a shared perforation portion with the perforated upper section and is located midway between vertical side edges of a front wall of said container, wherein the fully detachable perforated middle section is aligned with said dispenser, and wherein the perforated upper section includes angled portions adjacent to the shared perforated portion.

2. The apparatus of claim 1, wherein the one or more serving vessels includes two serving vessels.

3. The apparatus of claim 2, wherein a first of the two serving vessels is held in a first corner of said container by said fluid-filled bladder, a second of the two serving vessels is held in a second corner of said container by said fluid-filled bladder, and said dispenser is located between the first and the second of the two serving vessels.

4. The apparatus of claim 1, wherein the fully detachable perforated middle section is of a size and shape appropriate to allow said dispenser to be secured.

5. The apparatus of claim 1, wherein said dispenser further includes a box engagement assembly that is received by the opening formed when the fully detachable perforated middle section is detached.

6. The apparatus of claim 1, wherein the perforated upper section is permanently attached to said wall such that said perforated section is movable between an open position and a closed position.

7. The apparatus of claim 1, wherein said dispenser includes a tap head.

8. The apparatus of claim 1, wherein the fluid is a dietary supplement.

9. An apparatus for liquid storage and dispensing, said apparatus comprising:

a bladder including an integrated dispenser in fluid communication with the interior of said bladder;

one or more serving vessels; and a container including one or more walls, a floor, and one or more flaps for sealing the container, wherein said floor and one or more walls define a hollow cavity formed inside of said container;

wherein the container includes a perforated section formed in at least one of said walls of said container;

wherein the perforated section includes a perforated middle section and a perforated upper section;

wherein said hollow cavity is configured to receive said bladder such that when said bladder is installed in said container the walls of said bladder directly abut the walls of said container, when said bladder is filled with fluid, wherein the one or more serving vessels is disposed in a corner of said container and abuts one side of said fluid-filled bladder;

wherein the perforated middle section is fully detachable from said wall in which said perforated middle section is formed so as to provide an opening for said dispenser to be pulled through said wall when a user is ready to use the dispenser for dispensing fluid from inside said bladder;

wherein the fully detachable perforated middle section shares a shared perforation portion with the perforated upper section and is located midway between vertical side edges of a front wall of said container;

wherein the fully detachable perforated middle section is aligned with said dispenser, and is of a size and shape appropriate to allow said dispenser to be secured;

wherein the perforated upper section includes angled portions adjacent to the shared perforated portion; and wherein when said dispenser is secured, said dispenser is secured by the angled portions and the opening formed when the fully detachable perforated middle section is detached.

10. The apparatus of claim 9, wherein the one or more serving vessels includes two serving vessels.

11. The apparatus of claim 10, wherein a first of the two serving vessels is held in a first corner of said container by said fluid-filled bladder, a second of the two serving vessels is held in a second corner of said container by said fluid-filled bladder, and said dispenser is located between the second of the two serving vessels.

12. The apparatus of claim 9, wherein a first, second, and third side of the perforated upper section are fully detachable from said wall, and a fourth side of the perforated upper section remains attached to said wall to allow for movement of the perforated upper section between a closed position and an open position.

13. The apparatus of claim 9, wherein said dispenser includes a tap head.

14. The apparatus of claim 9, wherein the fluid is a dietary supplement.

15. A dietary supplement storage and dispensing apparatus, comprising:

a bladder including an integrated dispenser in fluid communication with the interior of said bladder;

one or more serving vessels; and a container including one or more walls, a floor, and one or more flaps for sealing the container, wherein said floor and one or more walls define a hollow cavity formed inside of said container;

wherein the container includes a perforated section formed in at least one of said walls of said container;

wherein the perforated section includes a perforated middle section and a perforated upper section;

wherein said hollow cavity is configured to receive said bladder such that when said bladder is installed in said container the walls of said bladder directly abut the walls of said container, when said bladder is filled with dietary supplement fluid, wherein the one or more serving vessels is disposed in a corner of said container and abuts one side of said dietary supplement fluid-filled bladder;

wherein the perforated middle section is fully detachable from said wall in which said perforated middle section is formed so as to provide an opening for said dispenser to be pulled through said wall when a user is ready to use the dispenser for dispensing dietary supplement fluid from inside said bladder;

wherein the fully detachable perforated middle section shares a shared perforation portion with the perforated upper section and is located midway between vertical side edges of a front wall of said container;

wherein the fully detachable perforated middle section is aligned with said dispenser, and is of a size and shape appropriate to allow said dispenser to be secured;

wherein the perforated upper section includes angled portions adjacent to the shared perforated portion; and wherein said dispenser further includes a box engagement assembly that is configured to be received by the angled portions and the opening formed when the fully detachable perforated middle section is detached.

16. The dietary supplement storage and dispensing apparatus of claim 15, wherein the apparatus includes two serving vessels.

17. The dietary supplement storage and dispensing apparatus of claim 16, wherein a first of the two serving vessels is held in a first corner of said container by said dietary supplement fluid-filled bladder, a second of the two serving vessels is held in a second corner of said container by said fluid-filled bladder, and said dispenser is located between the first and the second of the two serving vessels.

* * * * *